United States Patent [19]

Noble, Jr.

[11] Patent Number: 5,037,679

[45] Date of Patent: Aug. 6, 1991

[54] DECORATIVE DISPLAY DEVICE

[76] Inventor: John T. Noble, Jr., 7370 Dunraven Pl., NW., Atlanta, Ga. 30328

[21] Appl. No.: 540,180

[22] Filed: Jun. 19, 1990

[51] Int. Cl.[5] ..... B44C 5/04

[52] U.S. Cl. ..... 428/10; D11/120; 156/63; 362/122; 493/958

[58] Field of Search ..... D11/119, 120; 428/7, 428/10, 13; 493/957, 958; 362/122; 248/27.8; 40/160; 52/36; 156/63

[56] References Cited

U.S. PATENT DOCUMENTS

| | | | |
|---|---|---|---|
| D. 168,961 | 3/1953 | Melaragno | D11/120 |
| D. 206,124 | 11/1966 | Burnbaum | D11/120 |
| 1,696,221 | 12/1928 | Tubbs | 428/10 X |
| 2,033,173 | 3/1936 | Barocas | 428/10 X |
| 2,086,958 | 7/1937 | Pollock | 428/10 X |
| 2,401,436 | 6/1946 | Nitzberg | 428/13 X |
| 2,682,727 | 7/1954 | Keljik | 428/13 X |
| 2,761,233 | 9/1956 | Brown | 428/10 X |
| 2,831,963 | 4/1958 | Kurianski | 428/13 X |
| 3,350,555 | 10/1967 | Di Rico | 428/10 X |
| 3,500,035 | 3/1970 | Franc | 428/10 X |
| 3,591,442 | 7/1971 | Matesi | 428/17 X |
| 3,614,840 | 10/1971 | Vadell | 428/13 |
| 4,100,316 | 7/1978 | Lackey | 428/10 |
| 4,353,327 | 10/1982 | Shroyer | 428/13 X |
| 4,525,393 | 6/1985 | DiCostanzo | 428/7 |

*Primary Examiner*—Henry F. Epstein
*Attorney, Agent, or Firm*—Thomas, Kerr & Kayden

[57] ABSTRACT

A decorative display device has a frame member, a first scenic member contained within the frame, and a second member spaced from the first member by spacer means. One or more apertures in the first scenic member permit viewing the second member. A floor plate is affixed to the front of the scenic member and extends outwardly therefrom.

21 Claims, 4 Drawing Sheets

DECORATIVE DISPLAY DEVICE

This invention relates to decorative display devices and to methods of making and assembling such devices.

BACKGROUND OF THE INVENTION

Decorative display devices for use in the home are quite popular, especially those displays which depict scenes or tableaus appropriate for particular occasions. Such devices are also prevalent in a commercial milieu where they may be used for advertising purposes, or to display particular products in a pleasing manner.

One very popular type of display device is a Christmas wreath, often hung on the outside of the front door of a house, or in a window or windows thereof. Such wreaths are most often made of suitable seasonal greenery, such as real or imitation holly or evergreen fronds. Examples of such wreaths are shown in U.S. Pat. Nos, 1,696,221 of Tubbs, 3,591,442 of Matesi and 4,100,316 of Lackey, each of which depict wreaths that may be assembled by the user. In order that the wreaths may be even more pleasing to the eye, they are often illuminated, which adds to the festive air created by the wreath. Examples of illuminated wreaths are shown in U.S. Pat. Nos. 2,033,173 of Barocas, 2,761,233 of Brown, and 3,350,555 of DiRico, all of which show means for mounting miniature light bulbs within or around the wreath. U.S. Pat. No. 3,500,035 of Franc shows a packaging ornament consisting of an illuminated wreath, wherein the electric power for the illumination is by batteries contained within or adjacent to the wreath. In many of the foregoing examples, as well as in U.S. design patent U.S. Pat. No. 206,124 of Burnbaum, a message or a scene is located in the center of the wreath and enhanced or lit by the illumination.

In all of the foregoing devices, the display of a scene or message is two-dimensional in nature, thereby placing limits on just what can be displayed, and, especially in the case of a scenic display, causing the display to lack realism and warmth. In U.S. design patent U.S. Pat. No. 168,961 of Melaragno, a wreath is shown having a single three dimensional figure of Santa Claus, which would appear to add an additional element of interest to the wreath, but the wreath itself does not appear to be readily adaptable to hanging because of the structure, being intended, instead, to stand upright on a flat surface, and it is limited, as well, in what can be displayed.

SUMMARY OF THE INVENTION

The present invention, including the principles thereof, is readily adaptable to a number of types of display devices, but, for simplicity, shall be discussed hereinafter as embodied in a Christmas wreath, which can be hung on a door or in a window.

The wreath of the present invention comprises an annular form upon which is arrayed suitable greenery. A first plate, comprising a first, scenic circular member and a second circular strengthening member fastened to the scenic member, is adapted to be mounted to the front of the annular form and substantially fill the open space thereof. The front surface of the scenic member has, for example, an exterior scene thereon, such as the exterior of a house with cut-out windows and a door, and the strengthening member has a large cut-out area so that a viewer can look through the windows and door without interference from the strengthening member. Affixed to the front of the scenic member below the windows and door or other openings and extending outwardly substantially at right angles thereto is a flat floor piece, which forms a patio in front of the house. An auxiliary floor piece is fastened to the lower surface of the flat floor piece and extends outwardly therefrom, thereby forming a step between a lower patio surface and the upper patio surface.

Affixed to the rear surface of the strengthening member below the cut-out portion thereof is a flat spacer member which extends toward the rear of the wreath substantially at right angles to the rear surface of the strengthening member and which forms the interior floor of the house depicted by the front plate.

A circular second plate having an interior scene on the front surface thereof is mounted at the rear of the annular form and held in spaced relationship to the front plate by the flat spacer member which may be affixed to the front surface of the second plate instead of to the strengthening member. The interior scene may be painted on the front surface of the second plate or may be built up from individual component pieces, so that a viewer may look through the windows or door of the first plate into the interior of the house.

The interior of the house is illuminated by one or more miniature light bulbs mounted on the rear surface of the strengthening member, the front surface of the second plate, or the top surface of the spacer member or any combination thereof. Electricity is made available to the bulbs by means of a lighting strip mounted, for example, to the rear surface of the strengthening member below the spacer member, which plugs into the household current. The lighting strip contains a transformer for reducing the household voltage to twelve volts, for example, for twelve volt bulbs. Alternatively, the lighting strip, to which the bulbs are connected, may be battery powered, thereby eliminating the need for household current. The second plate has a cut-out therein below the spacer location for providing access to the lighting strip from the rear of the wreath.

In a second illustrative embodiment of the invention, wherein the wreath is adapted, for example, to be hung from the ceiling in the interior of a house, the wreath has a scene on both sides thereof, so that it may be viewed from either side.

In this embodiment, a second annular form is joined to the first annular form to create a single annular frame member of approximately twice the depth achievable with a single form.

The first plate is mounted in the opening in one side of the wreath and the second plate is mounted in the opening in the other side of the wreath. Both the first and second plates have apertures cut therein so that a viewer can see right through the wreath openings. The apertures preferably have straight bottom edges. For descriptive purposes only, the first plate will be referred to as the front plate, having front and rear surfaces, and the second plate will be referred to as the rear plate, having front and rear surfaces. The spacer member extends from the front surface of the rear plate to the rear surface of the front plate, and is substantially flush with the bottom edges of the apertures in the two plates. The front plate has a floor piece mounted to the front surface thereof substantially flush with the bottom edge of the aperture, and the rear plate has a floor piece mounted to the rear surface thereof substantially flush with the bottom edge of its aperture so that the two floor pieces, the spacer member, and the bottom edges of the apertures are co-planar.

A scene is built up on the spacer member and the floor pieces, such as a small town and a railroad track with a small electric train, and illuminated by miniature electric light bulbs mounted within the space between the two plates. For added interest, where an electric train is used, a molded hill with a tunnel cut therethrough is added. With such an arrangement, the scene can be viewed from either side of the wreath, which is desirable where the wreath is hung from the ceiling for example by suitable hanging means. Electric power to the wreath is supplied by electric cord extending along the hanging means and connected to one or more lighting strips mounted below the spacer member to, for example, the rear surface of the front plate and the front surface of the rear plate.

Inasmuch as the various components of the wreath are relatively simple, the wreath may be assembled by the user in the sequence in which the components are discussed in the foregoing. The user can select or create whatever scene he desires to achieve a desired result, which will be depicted in an illuminated, three dimensional scene.

DETAILED DESCRIPTION

The invention is described in the following as embodied in a Christmas wreath. It is to be understood, however, that the principles of the invention as discussed hereinafter are applicable to a large number of types of decorative display devices.

Figure 1:
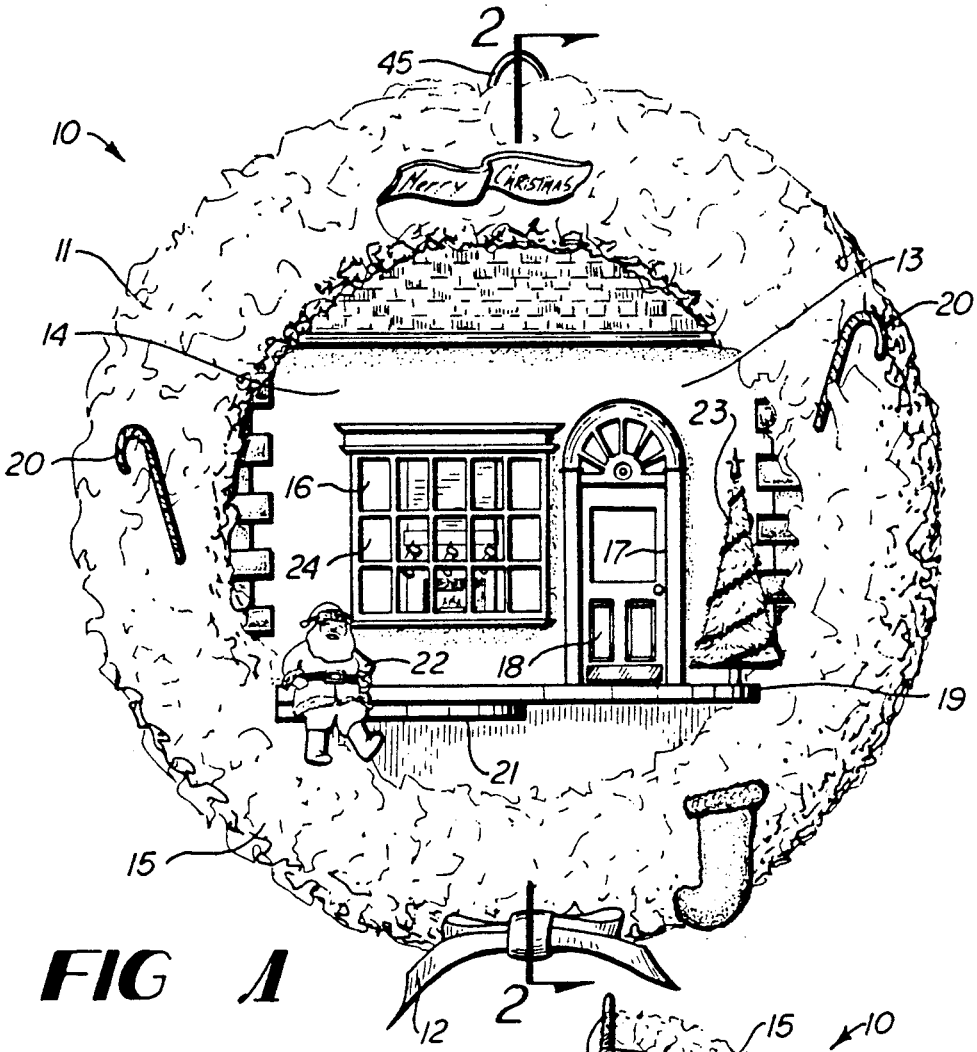
FIG. 1 is a front elevational view of a decorative wreath embodying the principals of the invention.

In FIG. 1 there is shown a Christmas wreath 10 having an annular ring 11 having thereon suitable greenery 15, such as real or imitation holly, pine sprigs or fronds, or the like and, if desired, a decorative bow 12 and candy canes 20. Within the open area 13 surrounded by the ring 11 is depicted a Christmas scene which comprises a first or front plate 14 having a window opening 16 with mullions and a door opening 17 with, for example, a moveable door 18. It is not necessary that door 18 be moveable, but it adds to the realism of the scene if it is. The remainder of the front surface of plate 14 can be painted to resemble the exterior of a house and if desired, built up imitation bricks or stones 30 may be added.

Extending from the front surface of plate 14 from below the window and door openings is a substantially flat floor piece 19, the top surface and edges of which may be painted or textured to resemble a flagstone or brick surfaced patio, for example, and mounted on the bottom surface of floor piece 19 is an auxiliary floor piece 21 which extends even farther out beyond the edge of floor piece 19 and may be painted or textured, thus creating a stepped patio effect. On the other hand, the top surface of piece 21 may be made to resemble grass. In keeping with the Christmas spirit of the wreath 10, a Santa Claus figure 22 is depicted sitting on piece 21, and an imitation Christmas tree 23 stands on the piece 19.

Mounted within the wreath opening 13 behind front plate 14, as viewed from the front, and spaced therefrom in a manner to be explained hereinafter, is a second or back plate 24, which will be discussed more fully in connection with FIGS. 2 and 3. Plate 24 has a scene painted or constructed on the front surface thereof such as, as shown in FIG. 1, a fireplace with Christmas stockings hanging from the mantel. The scene on the front surface of plate 24 is located so as to be clearly visible through the window 16.

The interior scene may also include other elements, such as furniture or the like, some of which may be visible when the door 18 is opened the entire interior scene may be enhanced by interior lighting, which will be discussed more fully hereinafter, with the net effect, to an observer looking at the front of the assembly, of a warm, festive scene.

Figure 2:
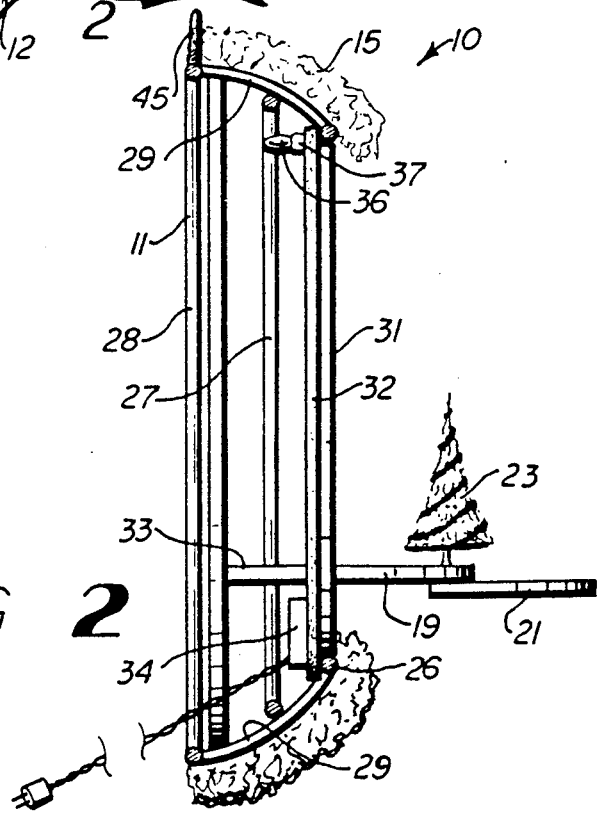
FIG. 2 is a side cross-sectional view of the wreath of FIG. 1 along the line 2—2 of FIG. 1.

FIG. 2 is a cross-section of the wreath 10 of FIG. 1, taken along the line 2—2 thereof. The wreath 10 comprises an annular wire frame member 11 comprising a plurality of circular wires 26, 27, and 28 of increasing diameters from front to rear of the wreath, and connected and maintained in spaced relationship by a plurality of stays 29, 29. The greenery 15 is attached to the frame member 11 in a suitable manner, as by twist ties, clips, or the like. First plate 14 is mounted and retained on the front of frame member 11 by any suitable means such as twist ties, wire ties, or the like which are concealed by the greenery 15. As seen in FIG. 2, plate 14 consists of a front, scenic member 31 and a strengthening member 32 fastened to the rear of member 31 by any suitable means. Member 31 is preferably made of an easily workable material, such as, for example, 3/16 inch foam core board, which can readily be cut to form window 16 and door opening 17. Member 32 on the other hand may be made of ¼ inch plywood. It is not necessary to use member 32 where member 31 is made of a material having sufficient rigidity and strength, but where numerous cut-outs are made in member 31, it can be weakened to where the use of member 32 is preferable. Floor piece 19, which may be made of ½ inch plywood, for example, can be glued, nailed, or fastened by screws to front plate 14, and floor piece 21 may likewise be so fastened to the bottom surface of piece 19. Inasmuch as floor pieces 19 and 21 constitute an additional load on front plate 14, especially when decorative pieces, such as the Santa Claus figure 22 and the tree 23, are placed thereon, the use of strengthening member 32 insures stability for the front plate assembly.

Plate 24 which may be made of ¼ inch plywood, for example, is mounted at the rear of frame member 11 and held in place by suitable means, such as twisted wires. A flat spacer member 33 which is preferably mounted to the front surface of plate 24 extends between plate 14 and plate 24 to help maintain them in spaced relationship. Spacer member 33 may also function as the floor of the house depicted in FIG. 1. Mounted on the rear surface of front plate 14, and below spacer member 33, is a lighting strip 34 for supplying electricity to one or more miniature light bulbs 36, for illuminating portions of the scenic display. Lighting strip 34 may be any of a number of different commercially available devices. One such device has an adhesive backing for mounting it to a surface, such as the rear surface of plate 14, and an electrical cord, as shown, for plugging into a household current outlet. Such a strip may contain a transformer for reducing the household voltage to, for example, twelve volts, and a plurality of sockets into which leads from the various miniature bulbs may be plugged. Alternatively, the strip may be battery powered, thus eliminating the necessity of a household current outlet. The bulb or bulbs 36 may be mounted in commercially available sockets 37 which can be mounted, in turn, to spacer member 33, the rear surface of plate 14, the front surface of plate 24, or any combination thereof to provide illumination for the scene, such as the interior of the house of FIG. 1.

Figure 3:
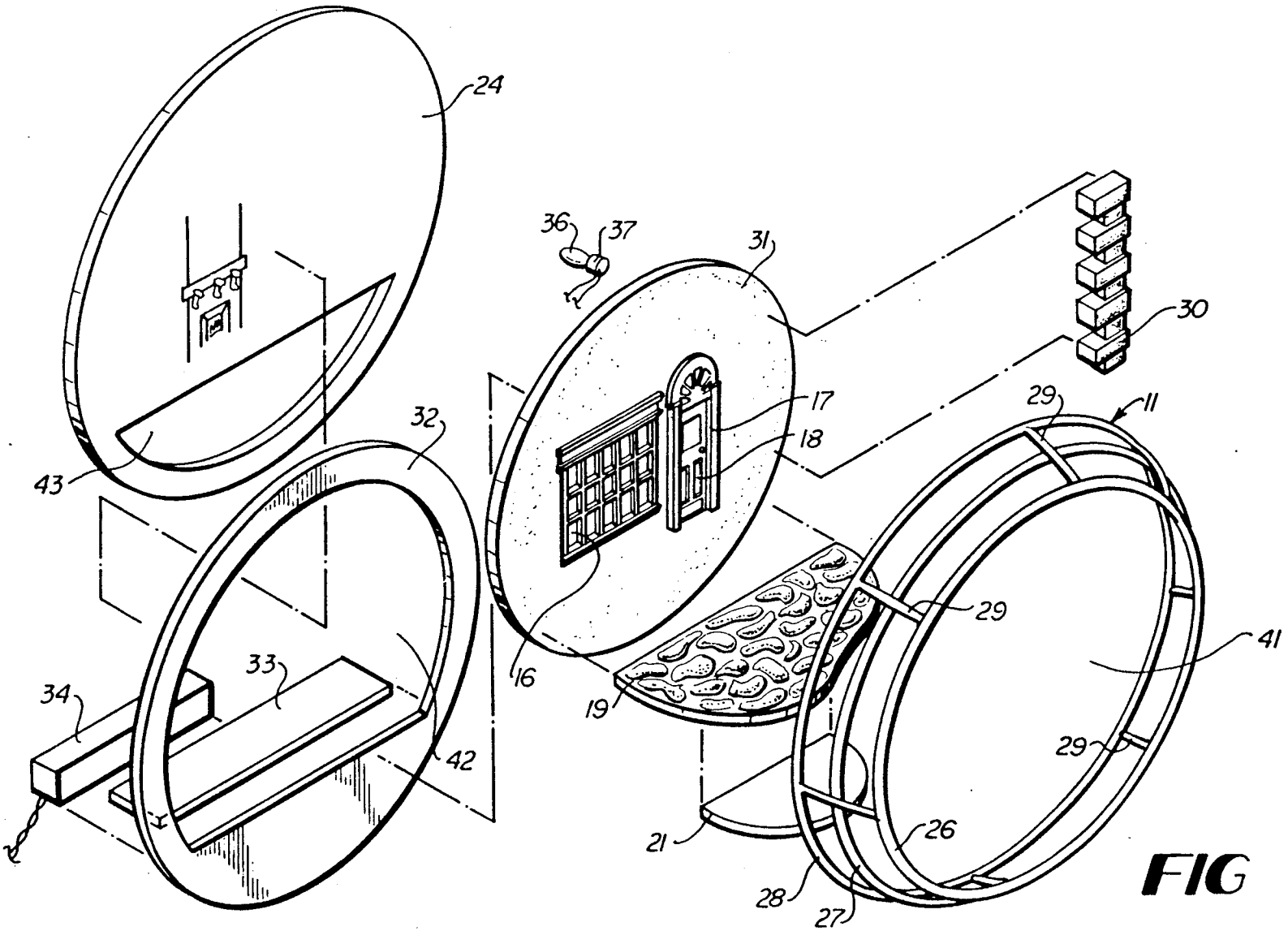
FIG. 3 is a perspective, exploded view of the components of the wreath of FIG. 1, showing the assembly sequence thereof.

In FIG. 3 there is shown an exploded view, in perspective, of the wreath of FIG. 1, showing the various components thereof in some details, and illustrating the sequence of steps in assembling the display device. Frame 11 is depicted as a wire frame, but it is to be understood that other types of frames might be used, such as a toroidal shaped member of polystyrene foam. The greenery, not shown, is affixed to the frame as by twisted ties, in the case of a wire frame, or by staples, for example, in the case of a polystyrene frame. The frame 11 defines a large open space 41 which is substantially completely filled by front plate 14, comprising scenic circular member 31 and a circular strengthening member 32 which is affixed to member 31. Member 31 may be cut off below the door opening 17 so that floor piece 19 may be mounted directly to strengthening member 32 and form a platform upon which member 31 rests. Member 32 has a large area cut-out 42 so that member 32 does not interfere with the view through window opening 16 and door opening 17. Back plate 24 has a cut-out portion 43 for providing access to lighting strip 34, both strip 34 and cut-out 43 being located below the plane of spacer member 33. A single bulb 36 and socket 37 are shown, with leads 44 from socket 37 for plugging into strip 34.

The procedure for assembling the display device of the invention is hereinafter described with reference to FIGS. 1 and 3. The principal steps in the assembly are the same for any decorative display device incorporating the principles of the invention, and whatever differences may exist are due only to a difference in the type of display.

When the basic theme of the display device, in this case, a Christmas wreath, is determined, the frame member 11 is decorated with the appropriate material, e.g., greenery. Scenic member 31 is then cut to form the window and door openings 16 and 17, and the exterior of the house is then painted on the front surface of member 31. Floor pieces 19 and 21 are painted or otherwise finished so that their top surfaces resemble, for example, a patio and grass, and they are then glued together or otherwise joined to each other. After cut-out 42 is formed in member 32 and where number 31 has been cut off below the door opening 17 floor piece 19 is mounted thereto below cut-out 42 as by screws or a strong cement, and member 31 is then cemented or otherwise joined to member 32, thereby forming front plate 14. Alternatively, floor piece 19 may be mounted directly to the front of number 31, as seen in FIG. 3. If illumination is to be used, one or more light sockets 37 are mounted to the rear of member 32, and lighting strip 34 is likewise mounted on the rear surface of member 32 below cut-out 42. Front plate 14 is then inserted into opening 41 and fixed in place at the front of frame 11 as by twisted wires or the like.

Back plate 24 has cut-out 43 formed therein and a scene painted or built up on its front surface. Spacer member 33 is mounted on the front surface below the scene as by screws or by cementing. As was pointed out hereinbefore, the top surface of spacer 33 may be finished to resemble the interior floor of the house, hence it should be located relative to the scene on plate 24 so as to resemble a floor, but it should likewise be located so as to contact the rear surface of member 32 below cut-out 42. At this point, where additional illumination in the finished device is desired, light sockets 37 may be mounted on the front surface of plate 24 and/or on spacer member 33. After light bulbs have been mounted in all sockets, plate 24 is inserted into frame 11 from the rear and mounted in place by suitable means. The leads from the various light sockets 37 can be connected to light strip 34 through access cut-out 43.

The device as thus assembled can easily be hung on a door or in a window by suitable hangers such as hanger 45, preferably attached to frame 11.

Figure 4:
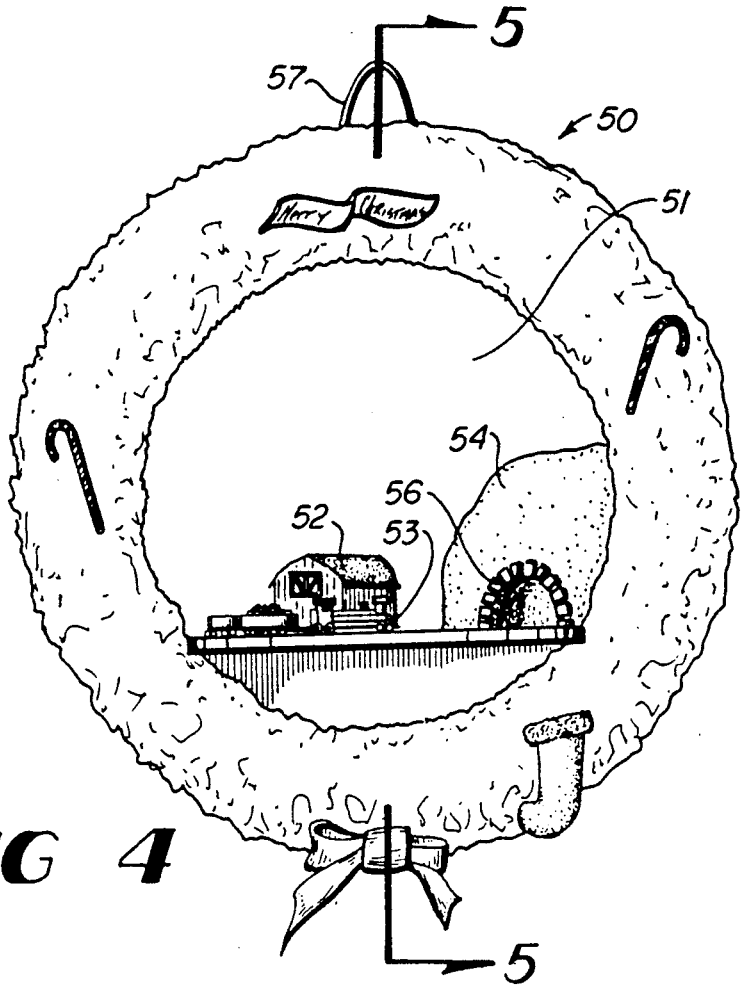
FIG. 4 is a front elevation view of a decorative wreath embodying the principles of the invention in another preferred embodiment thereof.

In FIG. 4 there is shown a second preferred embodiment of the invention comprising a wreath 50 in which the open area 51 contains a scene that can be viewed from either side of the wreath. As depicted in FIG. 4 for illustrative purposes only, the scene is a rural one comprising a barn 52 and a miniature electric train 53 traveling in a loop around the barn. For added interest, a hill 54 having a tunnel 56 is provided through which the train passes. A hanger 57 is shown, and it is to be understood that it is representative of any of a number of types of hangers that may be used, depending upon where the wreath is to be hung.

Figure 5:
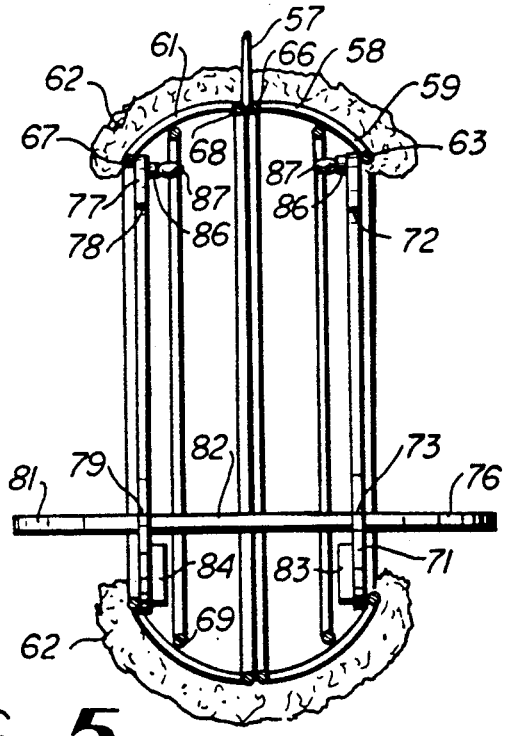
FIG. 5 is a side cross-sectional view of the wreath of FIG. 4 along the line 5—5 of FIG. 4.

In FIG. 5 it can be seen that the wreath comprises a frame 58 comprising first and second frame members 59 and 61, each of which is basically the same as frame member 11 of FIG. 2, and which are mounted and secured back to back to produce an annular frame 58 that is substantially twice the depth of member 11. Suitable greenery 62 is attached to the exterior of the frame 58. First frame member 59 has a front wire ring 63 which is the smallest diameter of the rings 63, 64, and 66 forming frame member 59 and rear ring 66, which is the largest diameter. In the same manner, frame member 61 has a small diameter front ring 67 a large diameter ring 68, and an intermediate ring 69. To avoid confusion, the description shall henceforth refer to the ring 63 as the front of the wreath 50 and ring 67 as the rear of the wreath, although it is to be understood that these designations are not meant to be limiting, since in this embodiment, if the wreath is viewed from the left side, ring 67 would actually be the front ring.

Mounted to ring 63 is a first, or front plate 71 having an enlarged aperture 72 therein. As will be more apparent in FIG. 6, the bottom edge 73 of aperture 72 is preferably straight. Plate 71 is shown in FIG. 5 as comprising a single member, made of, for example, ¼ inch plywood. It is to be understood that plate 71 may be made of a scenic member and a strengthening member, as in the arrangement of FIG. 2, although, in this embodiment, a scenic member is not strictly necessary.

A first floor plate 76 extends from the front surface of plate 71 and is affixed thereto. Plate 76, which may be, for example, made of ¼ inch plywood is flat and mounted flush with the bottom edge 73 of the aperture 72. Mounted to ring 67 is a second, or back plate 77 of, for example, ¼ inch plywood, which has an enlarged aperture 78, the bottom edge 79 of which is straight and co-planar with edge 73 of aperture 72 when the plates 71 and 77 are in their mounted positions. A floor plate 81 extends from the rear surface of plate 77 and is mounted thereto flush with the bottom edge 79 of aperture 78. Thus, when mounted on the frame, plates 76 and 81 and edges 73 and 79 are co-planar. Between the rear surface of plate 71 and the front surface of plate 77 is located a flat spacer member 82 which may be of ½ inch plywood and which is mounted to one or both of plates 71 and 77 co-planar with floor plates 76 and 81 and edges 73 and 79, thereby forming a continuous surface. A first lighting strip 83 is mounted to the rear surface of plate 71 below the spacer 82 and, for additional power, a second lighting strip 84 is mounted to the front surface of back plate 77 below the spacer 82. As with the wreath of FIGS. 1 through 3, light sockets 86 and miniature bulbs 87 are provided to illuminate the scene.

Figure 6:
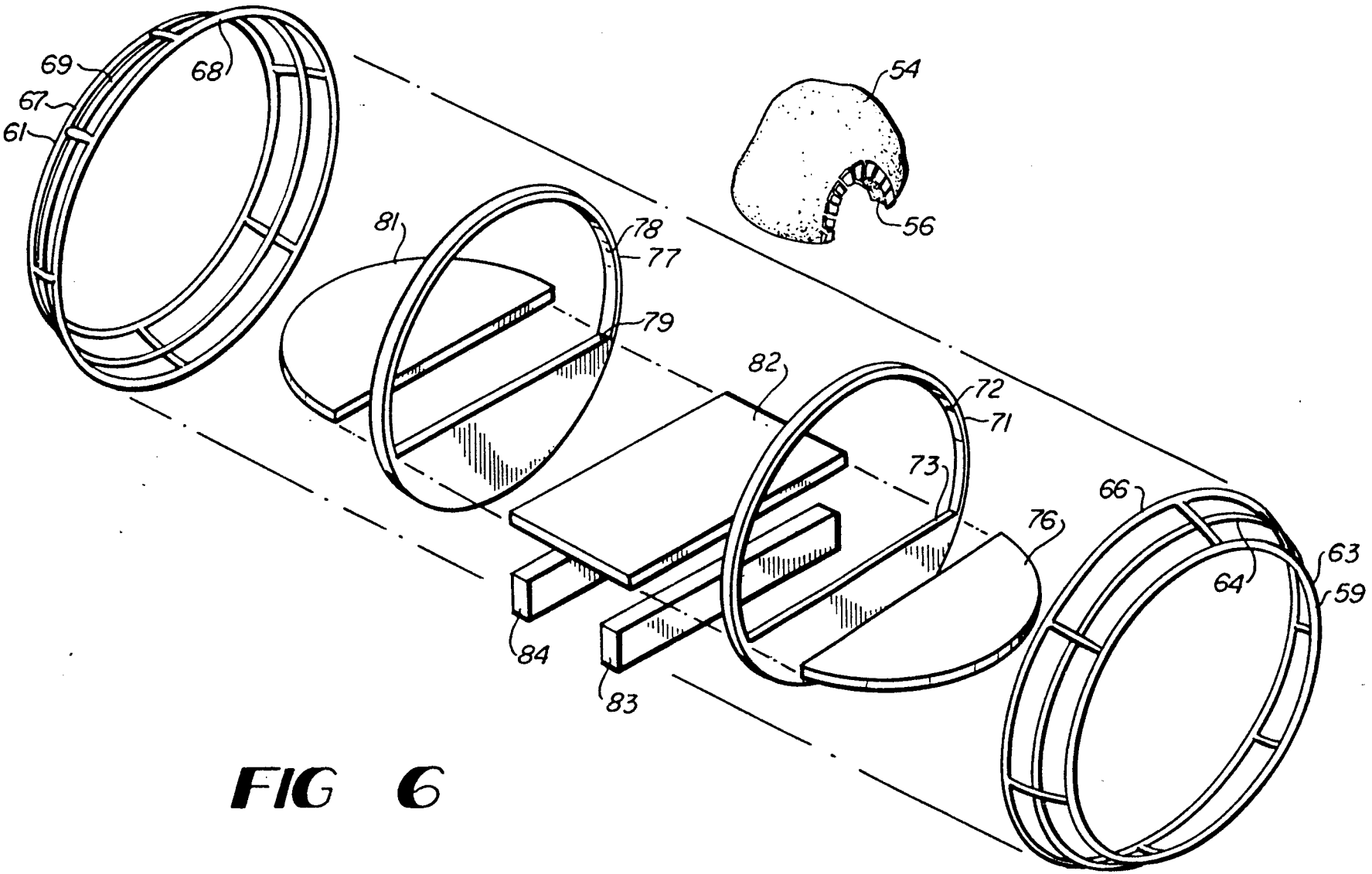
FIG. 6 is a perspective, exploded view of the components of the wreath of FIG. 4, showing the assembly sequence thereof.

FIG. 6 depicts the various components of the wreath 50 in an exploded, perspective view. From FIG. 6, the assembly sequence can readily be understood. Thus floor plate 76 is first mounted to the front surface of plate 71 flush with edge 73, lighting strip 83 is then mounted to the rear surface of plate 71 and spacer 82 is likewise mounted thereto. Floor plate 81 is mounted on the rear surface of plate 77 and lighting strip 84 is mounted on the front surface thereof below the edge 79 of aperture 78. The front surface of plate 77 is then mounted to spacer 82. At this point, decorative material such as hill 54 and a train track and barn, not shown, may be mounted on the floor formed by floor plates 76 and 81, edges 73 and 79, and spacer 82. The light sockets and bulbs, not shown, are now mounted in place. Frame member 59 is then passed over plate 71 and plate 71 is affixed to ring 63. Frame member 61 is passed over plate 77, which is then affixed to ring 67. Rings 66 and 68 are then connected together by any suitable means, such as, for example, wire ties. Adding the greenery and the decorative material then follows.

The features and principles of the present invention have been illustrated in a preferred embodiment thereof in the form of a Christmas wreath. Numerous other types and forms of decorative display devices may be made which embody these features and principles, and numerous variations may occur to workers in the art without departure from the spirit and scope of the invention.

I claim:

1. A display device comprising:

a frame member surrounding and defining an open area and having a front side and a rear side, a first plate member having front and rear surfaces mounted in said frame member adjacent the front side thereof and adapted to fill at least a portion of the said open area, said first plate having one or more openings therein, a second plate member having front and rear surfaces mounted in said frame member adjacent the rear side thereof with its front surface spaced from the rear surface of said first plate member, and means for maintaining said second plate member in spaced relationship to said first plate member comprising a spacer member mounted between the rear surface of said first plate member and the front surface of said second plate member and extending therebetween.

2. A display device as claimed in claim 1 and further comprising a substantially flat floor piece having upper and lower surfaces mounted to the front surface of said first plate member and extending forwardly of said first plate member substantially at right angles thereto.

3. A display device as claimed in claim 2 wherein said floor piece is mounted to the front surface of said first plate member below said one or more openings.

4. A display device as claimed in claim 2 and further comprising:

an auxiliary floor piece mounted to the lower surface of said flat floor piece and extending further from the front surface of said front plate member than said flat floor piece.

5. A display device as claimed in claim 1 wherein said second plate member has an opening therein for providing an unobstructed view through at least a portion of the open area of said device.

6. A display device as claimed in claim 1 wherein said first plate member comprises a first, scenic member having front and rear surfaces and a second strengthening member fastened to the rear surface of said first, scenic member.

7. A display device as claimed in claim 6 wherein said strengthening member has an aperture therein larger than said openings.

8. A display device as claimed in claim 1 wherein said frame member forms a circular wreath.

9. A display device as claimed in claim 1 wherein said first plate member has a decorative scene depicted on the front surface thereof.

10. A display device as claimed in claim 1 wherein the front surface of said second plate member has a decorative scene depicted thereon, said scene being visible through the openings in said first plate member.

11. A display device as claimed in claim 1 and further including means for illuminating the space between said first plate member and said second plate member.

12. A display device as claimed in claim 11 wherein said means for illuminating comprises a lighting strip and one or more light bulbs.

13. A display device comprising:

a frame surrounding and defining an open area and having front and rear portions, a first plate having front and rear surfaces adapted to fill at least a portion of the said open area, said first plate having an aperture therein and being mounted to said front portion of said frame, a second plate having front and rear surfaces adapted to fill at least a portion of said open area, said second plate having an aperture therein and being mounted to said rear portion of said frame, means for maintaining said second plate in spaced relationship to said first plate comprising a spacer member mounted between said rear surface of said first plate and said front surface of said second plate, and means for mounting said display device in a display position.

14. A display device as claimed in claim 13 wherein the aperture in said second plate is aligned with the aperture in said first plate to provide an unobstructed view through said device.

15. A display device as claimed in claim 14 wherein the aperture in said first plate has a straight bottom edge and the aperture in said second plate has a straight bottom edge, the bottom edges of the apertures being co-planar.

16. A display device as claimed in claim 15 wherein said spacer member is co-planar with said bottom edges.

17. A display device as claimed in claim 16 and further including a first floor plate mounted to the front surface of said first plate and a second floor plate mounted to the rear surface of said second plate.

18. A display as claimed in claim 17 wherein said floor plates are co-planar with said spacer member.

19. A method of assembling a display device wherein said device comprises a frame having front and rear portions defining an opening comprising the steps of:

mounting an apertured first plate having front and rear surfaces and adapted to fill at least a portion of the opening to the front portion of the frame, mounting a second plate having front and rear surfaces and adapted to fill at least a portion of the opening to the rear portion of the frame;

mounting a first floor plate to the front to the front surface of the first plate, and mounting a spacer member between the rear surface of the first plate and the front surface of the second plate.

20. A method of assembling a display device as claimed in claim 19 and further including the step of mounting a second floor plate to the rear surface of the second plate to be co-planar with the first floor plate.

21. A method of assembling a display device as claimed in claim 19 and further including the step of adding scenic elements to the display device.

* * * * *